United States Patent [19]

Vinciguerra

[11] Patent Number: 4,736,945

[45] Date of Patent: Apr. 12, 1988

[54] ASSEMBLY FOR DEMOUNTABLY SECURING A JUMP ROPE TO A SUBSTANTIALLY VERTICAL SURFACE

[76] Inventor: Eugene Vinciguerra, P.O. Box 1523, Stow, Ohio 44224

[21] Appl. No.: 419,943

[22] Filed: Sep. 20, 1982

[51] Int. Cl.[4] ..... A63B 5/20

[52] U.S. Cl. ..... 272/75; 285/396; 403/348

[58] Field of Search ..... 272/75, 74, 77, 78, 272/76; 109/74, 75; 285/396, 361; 27/17; 403/348

[56] References Cited

U.S. PATENT DOCUMENTS

| | | | |
|---|---|---|---|
| 622,313 | 4/1899 | Woodvine | 285/396 X |
| 770,869 | 9/1904 | Roe | 272/78 |
| 782,332 | 2/1905 | Goldsmith et al. | 272/77 |
| 904,200 | 11/1908 | Harris | 285/396 |
| 2,230,098 | 1/1941 | Wurzburger | 285/361 X |
| 3,263,995 | 8/1966 | Morrow | 272/75 |
| 4,158,457 | 6/1979 | Hydro | 272/75 |
| 4,375,886 | 3/1983 | Muys | 272/75 |

*Primary Examiner*—Richard J. Johnson

[57] ABSTRACT

An assembly (10) for demountably securing one end of a jump rope (18) to a substantially vertical surface (12). A planar base (11) is affixed to the surface (12), as by screws (30), and the base presents the lugs (23 and 24) of a bayonet mount (14). A receptacle (13) has a central hub (35) and a peripheral rim (36) that are interconnected by a generally planar web (38). The slots (41 and 42) for the bayonet mount (14) are provided in the web (38) and permit demountably securing the receptacle (13) to the base (11). The hub (35) has a hollow, interior cavity (48) which rotatably receives a bushing (15) to which the rope (18) is secured. The configuration of the cavity (48) and the bushing (15) cooperates to minimize rotative frictional resistance therebetween.

6 Claims, 1 Drawing Sheet

FIG. 1
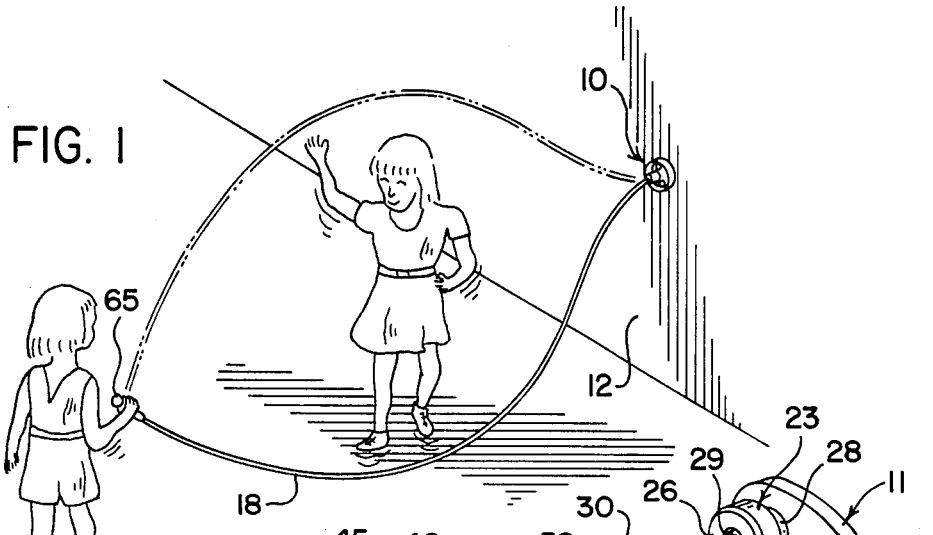
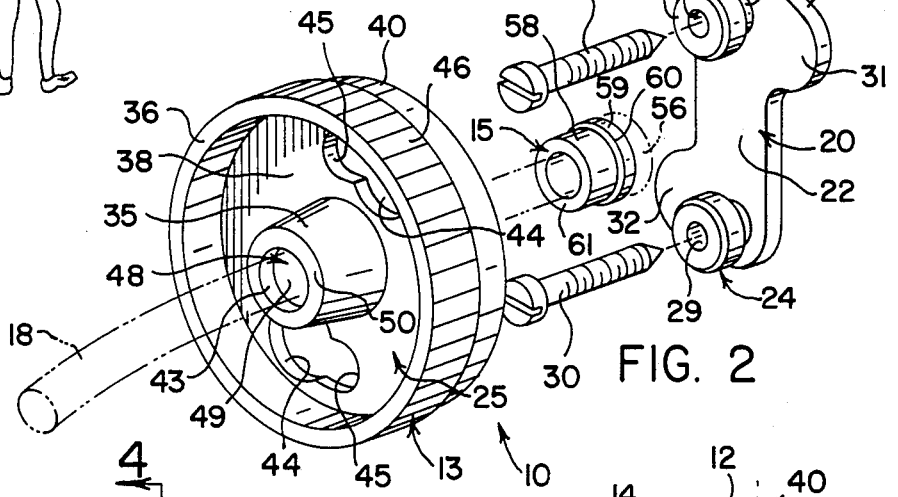
FIG. 2
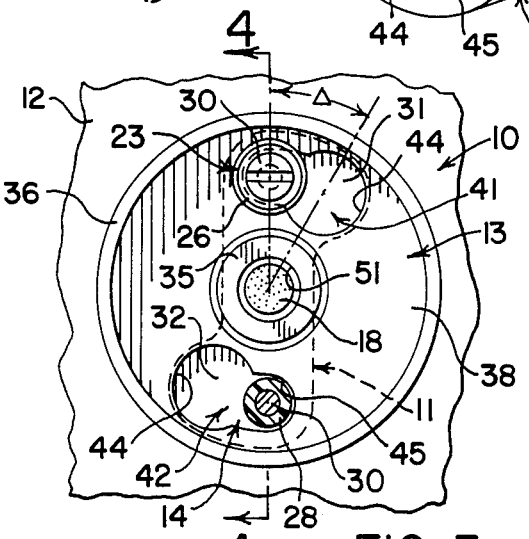
FIG. 3
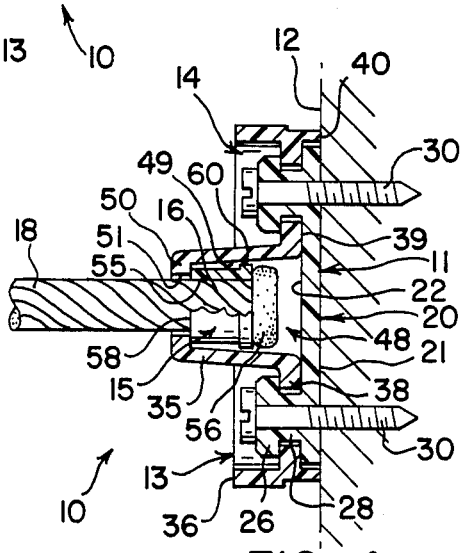
FIG. 4

ASSEMBLY FOR DEMOUNTABLY SECURING A JUMP ROPE TO A SUBSTANTIALLY VERTICAL SURFACE

TECHNICAL FIELD

The present invention relates to jump ropes, and more particularly to an assembly by which one end thereof may be demountably secured to a substantially vertical surface. Specifically, the present invention relates to an assembly which not only permits facile mounting and demounting but also permits the jump rope to be used continuously without binding or twisting.

BACKGROUND ART

Jumping rope has been a vital part of children's activities for a long time. Many different varieties of jump rope games have been played by children, involving one or more participants. Jump ropes, themselves, have ranged from mere lengths of rope, or cord, to sophisticated items with special handles and swivels. These different types of jump ropes have been adapted, with varying degrees of success, to various jump rope games.

However, when there is only one rope and two participants, no satisfactory arrangement has, to this point, been known. When there are three, or more, participants, there are always two who can swing the rope for the other to jump, and the participants can trade between the jumping and the swinging activities. When only two participants are available with a single rope, one generally does nothing while the other jumps.

So that both can participate simultaneously one end of the rope is often tied to a tree, a door handle or the like, so that one can swing while the other jumps. Such arrangements generally cause the rope to twist so that every so often the participants must stop and untwist the rope. Moreover, such an arrangement severely restricts the locations where it can be employed.

DISCLOSURE OF THE INVENTION

It is, therefore, a primary object of the present invention to provide an assembly by which one end of a jump rope can be demountably secured to most any vertically, or substantially vertically, oriented surface.

It is another object of the present invention to provide an assembly, as above, by which one end of a jump rope can be so secured and yet be freely rotatable to permit continuous swinging thereof without twisting or binding.

It is a further object of the present invention to provide an assembly, as above, which permits a base portion thereof to be semi-permanently affixed to a substantially vertical surface at the desired location and which permits the remainder of the assembly, and the jump rope to be demountably secured thereto with facility.

It is yet another object of the present invention to provide an assembly, as above, which constitutes an educational tool in that a teacher can instruct young children, or even partially handicapped individuals, to jump rope without requiring an aide to assist in swinging the rope properly.

These and other objects of the invention, as well as the advantage thereof over existing and prior art forms, which will be apparent in view of the following specification are accomplished by means hereinafter described and claimed.

In general, an assembly embodying the concept of the present invention has a base that can be semi-permanently affixed to a substantially vertical surface. A receptacle is demountably secured to the base, as by a bayonet mount, and a bushing is captured by the receptacle when it is secured to the base. One end of a jump rope is anchored to the bushing, and the bushing is freely rotatable within the receptacle in response to rotation and/or twisting of the rope. As such, even though the receptacle rotatably captures the bushing, the rope must be free to rotate, or twist, with respect to the receptacle.

One preferred embodiment of an assembly for demountably securing a jump rope to a substantially vertical surface which incorporates the concept of the present invention is shown by way of example in the accompanying drawings without attempting to show all of the various forms and modifications in which the invention might be embodied; the invention being measured by the appended claims and not by the details of the specification.

BRIEF DESCRIPTION OF THE DRAWINGS

FIG. 1 is a schematic perspective depicting an assembly embodying the concept of the present invention being employed demountably to secure one end of a jump rope to a substantially vertical surface while one participant swings the rope and another is jumping;

FIG. 2 is an enlarged, exploded perspective of the assembly employed in FIG. 1;

FIG. 3 is a frontal elevation, partly broken away, of the assembly depicted in FIGS. 1 and 2; and, FIG. 4 is a vertical section taken substantially along line 4—4 of FIG. 3.

A PREFERRED EMBODIMENT FOR CARRYING OUT THE INVENTION

An assembly which embodies the concept of the present invention for demountably securing one end of a rope to a substantially vertically oriented surface such as a wall, post, tree, or the like, while permitting the rope freely to rotate with respect to the assembly and thereby opertably function as a jump rope, is depicted in the drawings and identified generally by the numeral 10.

The assembly 10 incorporates a base 11 which is depicted as being semi-permanently secured to a substantially vertical surface 12. A receptacle 13 is, in turn, demountably secured to the base 11 by a bayonet type mount 14, and a bushing 15 is captured within the receptacle 13 when it is mounted on the base 11. The end 16 of a jump rope 18 is anchored within the bushing 15.

The base 11 has a generally planar body portion 20, the rear face 21 of which is preferably flat to engage the mounting surface 12. The obverse face 22 is also conveniently flat, and two laterally spaced, and diametrically opposed, lugs 23 and 24—which form the male members of the bayonet mount 14—extend perpendicularly outwardly from the obverse face 22. The lugs 23 and 24 are diametrically opposed along a bayonet circle 25.

Each lug 23 and 24 has a conveniently identical, enlarged head 26 spaced outwardly of the obverse face 22 by a neck 28. Each neck 28 is of lesser diameter than the diameter of the head 26. The criteria for determining the optimum dimensions for the aforesaid diameters, as well as the required axial extent of the neck 28 will become hereinafter more apparent in conjunction with the description of the receptacle 13.

Each lug 23 and 24 is also provided with a bore 29 which extends axially therethrough. Means, such as the pan heads screw 30, semi-permanently secure the base 11 to the surface 12 and are received through the bores 29.

In order to conserve material the base 11 need only be of generally rectangular configuration. However, it is deemed that the aesthetic appearance of the overall assembly 10 is enhanced by having the planar body portion 20 of the base 11 incorporate optionally extending lobes 31 and 32, one in proximity to each lug 23 and 24, the purpose for which will hereinafter become more apparent.

The receptacle 13 has a central, annular hub 35 and a peripheral rim 36 interconnected by a generally planar web 38. The rear face 39 of the web 38 is preferably flat to engage the obverse face 22 on the body portion 20 of the base 11. The rear face 39 of the receptacle 13 may be axially recessed with respect to the edge 40 of the rim 36 to permit the body portion 20 of the base 11 to seat within the receptacle 13 when the base and the receptacle are assembled.

A pair of diametrically opposed slots 41 and 42 are provided through the web 38 and comprise the female portion of the bayonet mount 14. Each slot 41 and 42 is formed by a pair of adjacent, intersecting bores disposed circumferentially about the axis 43 of the central hub 35. The circumferential disposition of the slots 41 and 42 must conform to the bayonet circle 25 along which the lugs 23 and 24 are disposed.

Each slot 41 and 42 includes a bore 44 located along the bayonet circle 25, the bore 44 in slot 41 being diametrically opposed to the bore 44 in slot 42. The diameter of bore 44 is larger than the diameter of the head 26 on each lug 22 and 24 to permit the head of each lug to be freely insertable through the bore 44 in the corresponding slots 41 and 42. An offset bore 45 in each slot 41 and 42, also located along the bayonet circle 25, is of a diameter lesser than the diameter of the head but greater than the diameter of the neck 28. The axial extent of the neck 28 is only a few thousandths of an inch (approximately 0.005 millimeters) greater than the thickness of the web 38.

The aforedescribed bayonet mount 14 permits the receptacle 13 to be selectively attached to and removed from the base 11 by a relatively uncomplicated manual manipulation of the receptacle 13 with respect to the base 11.

Specifically, to secure the receptacle 13 to the base 11 the heads 26 of the lugs 23 and 24 are simultaneously inserted through the first bores 44 of the appropriate slots 41 and 42 until the rear face 39 of the web 38 engages the obverse face 22 on the body portion 20 of the base 11. The receptacle 13 is then rotated clockwise, as viewed in FIGS. 2 and 3, until the edge of the offset bores 45 are captured between the heads 26 of the lugs 23 and 24 and the obverse face 22 on the body portion 20 of the base 11. To facilitate the rotative manipulation of the receptacle 13 required to engage, or disengage, the bayonet mount 14, the radially outer surface of the rim 36 may be serrated, or otherwise provided with a slip-free surface 46.

In the preferred embodiment depicted, the angular rotation $\Delta$ of the receptacle 13 required to affect engagement, and disengagement, of the bayonet mount 14 is on the order of 30 to 35 degrees. When the receptacle 13 is thus secured to the base 11 by the bayonet mount 14, the lobes 31 and 32 are positioned behind the bores 44, and are visable therethrough, thus providing an aesthetic visual continuity to the assembly 10.

The interior the central hub 35 is hollowed to provide a cavity 48 having the configuration of a truncated cone. As such, the base of the conical cavity 48 opens through the rear face 39 of the web 38 and the interior wall 49 of the hub 35 conically converges axially outwardly within the hub 35 to terminate at the radially inwardly directed lip 50 which delineates the axially outermost extent of the hub 35 and which circumscribes the bore 51 through which the jump rope 18 is freely received.

The bushing 15 is retained within the hub 35 by the lip 50, and the bushing itself has a cylindrical bore 55 extending axially therethrough. The diameter of the bore 55 is substantially equal to the outer diameter of the rope 18 so that the rope can extend therethrough. If the rope 18 is made of a synthetic material, such as Dacron, the end can be melted and axially flattened to present a radially extending, slightly bulbous collar 56 which will not pass through the bore 55 and which thereby serves to anchor the end of the rope 18 within the bushing 15.

The axial dimension of the bushing 15 is lesser than the axial extent of the cavity 48 within the central hub 35 to allow ample space so that the collar 56 will not bind against the obverse face 22 of the base 11.

The outer surface 58 of the bushing 15 is preferably cylindrical except for an annular rib 59 which defines the axially intermost extent of the outer surface 58 and which extends radially outwardly of the surface 58. The radial extent of the rib 59 is selected such that the outer edge 60 thereof just engages the interior wall 49 of the cavity 48 within the hub 35 when the axial end surface 61 of the bushing 15 engages the lip 50. By employing this outer configuration for the bushing 15 the frictional, rotative resistance between the bushing 15 and the interior of the hub 35 is greatly minimized. In fact, the bushing 15 only contacts the interior of the hub 35 at those two locations—the surface contact between the lip 50 and the end surface 61 of the bushing 15 and the linear contact between the outer edge 60 of the rib 59 and the interior wall 49 of the hub 35.

Accordingly, the bushing 15 is, for all practical purposes, freely rotatable within the hub 35.

A similar bushing arrangement can also be employed within the handle 65, and in that way the rope 18 can not twist, bind or foul by usage, irrespective of how many times, or the direction in which, the rope is swung for jumping.

Thus, an assembly embodying the concept of the present invention permits one end of a jump rope to be demountably secured to a substantially vertical surface for use without twisting or binding, and otherwise accomplishes the objects of the invention.

I claim:

1. An assembly for demountably securing one end of a jump rope to a substantially vertical surface comprising:

a base having a generally planar body portion suitable for affixation to a substantially vertical surface;

means to affix the base to a substantially vertical surface;

a receptacle;

said receptacle having a central hub;

a hollow cavity within said central hub;

a radially inwardly directed lip delineating the axially outermost extent of said central hub;

a bore being circumscribed by said lip; said bore communicating between said hollow cavity and the exterior of said receptacle;

said receptacle also having an axially extending radially distal peripheral rim to facilitate rotative manipulation of said receptacle;

said peripheral rim being interconnected to said central hub by a generally planar web;

a bayonet mount;

said bayonet mount being operative between said base and said planar web to permit demountably securing said receptacle to said base;

a bushing, said bushing being rotatably captured within said cavity and being retained therein by said lip when said receptacle is secured to said base;

a jump rope having opposite ends;

one end of said jump rope being anachored to said bushing; and, said bore permitting said rope to extend freely outwardly of said hollow cavity.

2. An assembly for securing one end of a jump rope to a substantially vertical surface, as set forth in claim 4, in which that portion of the bayonet mount presented from said base comprises spaced, diametrically opposed lugs extending perpendicularly outwardly of said body portion, each lug having an enlarged head spaced outwardly of the body portion by a neck of lesser diameter than the diameter of said head; and, said lugs cooperatively interacting with a pair of slots in the web portion of said receptacle to effect the bayonet mount.

3. An assembly for securing one end of a jump rope to a substantially vertical surface, as set forth in claim 2, in which said slots are each comprised of intersecting bores, the first such bore being of a diameter such as to permit the corresponding head on the lugs presented from said base to be freely insertable therethrough; each slot also comprising a bore offset from said first bore, said offset bore being of a diameter lesser than the diameter of said head but greater than the diameter of said neck; and, the axial extent of said neck being only slightly longer than the thickness of said web.

4. An assembly for securing one end of a jump rope to a substantially vertical surface, as set forth in claim 2, in which the means to affix the base to a substantially vertical surface extends axially through said lugs.

5. An assembly for securing one end of a jump rope to a substantially vertical surface, as set forth in claim 4, in which oppositely directed lobes are presented by the planar body portion of said base, one in proximity to each said lug; said lobes being visible through the first bores of the respective bayonet slots when the receptacle is mounted on said base.

6. An assembly for demountably securing one end of a jump rope to a substantially vertical surface, said assembly comprising:

a base having a generally planar body portion suitable for affixation to the substantially vertical surface;

means to affix said base to the substantially vertical surface;

a receptacle;

said receptacle having a central hub and a peripheral rim, said peripheral rim being interconnected to said central hub by a generally planar web;

a bayonet mount;

said bayonet mount being operative between said base and said planar web to permit demountably securing said receptacle to said base;

a bushing;

a jump rope having opposed ends;

one end of said jump rope being anchored to said bushing;

said bushing being rotatably captured within said central hub when said receptacle is secured to said base; and, means to permit said jump rope to extend freely outwardly of said central hub when said bushing is captured within said central hub.

* * * * *